United States Patent [19]

DiCostanzo

[11] Patent Number: 4,525,393

[45] Date of Patent: Jun. 25, 1985

[54] NOVELTY GREETING GIFT APPARATUS

[75] Inventor: Pam DiCostanzo, Northbrook, Ill.

[73] Assignee: PD Giftware Designs, Inc., Deerfield, Ill.

[21] Appl. No.: 657,610

[22] Filed: Oct. 4, 1984

[51] Int. Cl.[3] ..... B44C 5/04

[52] U.S. Cl. ..... 428/7; 428/10; 428/906.6; 428/913.3

[58] Field of Search ..... 428/7, 10, 27, 542.4, 428/906.6, 913.3

[56] References Cited

U.S. PATENT DOCUMENTS

| | | | |
|---|---|---|---|
| 2,547,676 | 4/1951 | Updike | 428/913.3 X |
| 2,575,470 | 11/1951 | Salz | 428/906.6 X |
| 2,811,030 | 10/1957 | Tannahill | 428/7 X |
| 3,591,442 | 7/1971 | Matesi | 428/10 |
| 4,058,215 | 11/1977 | Marchbank | 428/906.6 X |
| 4,144,365 | 3/1979 | Scudder et al. | 428/10 |

*Primary Examiner*—Henry F. Epstein

*Attorney, Agent, or Firm*—Dick and Harris

[57] ABSTRACT

A novelty greeting gift apparatus for conveying greeting indicia in a preservable gift environment. A first decorative material is stretched between an inner and outer hoop element and is joined immediately below the bottom surfaces of the hoop elements to one or more decorative skirt framing materials, continuously about the outer periphery of the first decorative material, to create a continuous bulky joinder region immediately below the frames to preclude the riding up or release from stretching, of the potentially slippery and/or porous material. A greeting card member with or without preprinted indicia message or decoration, is restrainably affixed to the upper surface of the first decorative material and additional decorative trim elements are operably attached to either the first decorative material or the first or second skirt framing materials, for overall enhancement of the gift accompanying the greeting card member.

13 Claims, 3 Drawing Figures

NOVELTY GREETING GIFT APPARATUS

BACKGROUND OF THE INVENTION

The present invention relates in general to novelty giftware and, in particular, to a novelty greeting gift apparatus for conveying greeting indicia usually embodied by a greeting card, in a preservable gift environment.

While for many years, greeting cards have been utilized to convey various greetings and messages in both a preprinted and nonpreprinted format, typically, most recipients of such cards quickly discard the card together with any personal messages that have been written into them.

It is thus an object of the present invention to provide such a greeting card which is integrated with a gift so as to be preservable and of such an attractive nature as to be desirous of being kept in a displayed position by the recipient of the greeting.

It is additionally an object of the present invention to provide such a novelty gift apparatus for conveyance of greeting indicia in such a preservable gift environment of such construction that the relatively porous and/or otherwise delicate fabrics utilized in association with the preservable gift portion are reinforced into a particular stretched configuration through barrier means that anchor the device and preclude undesirable slippage of the materials utilized in the gift to keep them in their intended displayable configuration.

It is additionally an object of the present invention to provide such a gift which is not only decorative in combination with the greeting indicia, but one which may be displayed easily at will by hanging on vertical surfaces such as walls, while conveying a "home-made" custom gift appearance, but which is still capable of expedited manufacture in a substantially facilitated manner with the minimum of effort.

Accordingly it is an object of the present invention to provide such a preservable greeting card-gift apparatus which is durable in nature so as to preclude undesirable running of materials utilized or decomposition, shrinking, shredding and/or riding up of the gift componentry so as to be displayable for many years.

These and other objects of the present invention will become apparent in light of the present specification, claims and drawings.

SUMMARY OF THE INVENTION

The present invention comprises a novelty greeting gift apparatus for conveyance of greeting indicia in a preservable gift environment. The apparatus comprises first decorative material means stretched into a substantially taut geometric configuration about inner hoop means having an interior surface and exterior surface. The bottom periphery of the first decorative tautly stretched material is closely juxtaposed and overlapping the exterior surface of the inner hoop means. Additionally, the top peripheral portion of the first decorative tautly stretched material underlaps the interior surface of an outer hoop means.

The inner and outer hoop means are concentric and juxtaposed proximate to one another in a substantially fixed relationship with the first decorative material means interposed therebetween so as to maintain the first decorative material in its substantially taut configuration.

The apparatus further comprises first decorative skirt material means which are operably attached to the extreme outer circumference of the first decorative material means at a joinder region. This joinder region is positioned beneath the lowermost edges of the proximately juxtaposed inner and outer hoop means at the location from which the first decorative material means (interposed therebetween the inner and outer hoop means) emanates downwardly therefrom. The joinder region serves as an anchor member to effectively lock the position of the first decorative material means in its taut stretched configuration within the exterior and interior surfaces of the inner and outer hoops respectively. Additionally, the first decorative skirt material means emanates outwardly from the joinder region in a comparable fashion, beneath the inner and outer hoop means, to define a decorative outer skirt member framing the other hoop.

Greeting card means are restrainably affixed to the upper surface of the first decorative material means and bear the greeting indicia thereupon. Additionally, decorative trim means are operably attached to the upper surfaces of one or more of the first decorative material means, the inner hoop, the outer hoop and/or the first decorative skirt means for overall enhancement thereof.

In the preferred embodiment of the invention the overall apparatus further comprises second decorative skirt material means which are operably attached to the extreme outer circumference of the first decorative material means and the inner peripheral portion of the first decorative skirt material at the previously mentioned joinder region. This second decorative skirt material means is positioned immediately below the first decorative skirt material means and emanates outwardly from the joinder region to define a second decorative outer skirt member immediately and outwardly framing the first decorative skirt material means.

The preferred embodiment of greeting gift apparatus further relies upon the utilization of a hanging ring attachment means comprising a hanging ring member attached to one or more of the first decorative material means, the first decorative skirt material means and/or the second decorative skirt material means. Through such use of a hanging ring member, restrained positioning and affixation of the overall apparatus is accomplished through "hanging" upon a substantially vertical surface such as a wall.

Preferably, the joinder region of the first decorative material means and the first decorative material skirt means comprises a substantial continuously attached region which creates a substantially bulky element incapable of being drawn through the region between the juxtaposed inner and outer hoop means. Such a construction effectively anchors the positions of both the first decorative material means and the first decorative material skirt means beneath the substantially juxtaposed bottom surfaces of the inner and outer hoop means. In one embodiment, this region of continuous attachment comprises a continuously sewn attachment bond between the first decorative material means and first decorative skirt material means, while in an alternative embodiment this continuous attachment region is fabricated through a continuous adhesive attachment bond such as that yielded by a substantially solid and/or liquid adhesive agent, or through a continuous thermoplastic attachment bond between the first decorative material and first decorative skirt material. In the thermoplastic bond embodiment, each of the first decorative material skirt means and the first decorative material means are fabricated of a substantially thermoplastic material capable of being bonded through application of thermoplastic bonding catalyst such as thermoplastic heat and/or thermoplastic radiation, to accomplish bonding therebetween.

In the preferred embodiment, the inner and outer hoop means comprise a substantially fixed inner embroidery hoop and a substantially adjustable outer embroidery hoop respectively. Additionally the geometric configuration for both the hoops and the overall shape of the stretched decorative material is that of a circle.

The greeting card means previously described are contemplated as comprising either a substantially flat greeting card for attachment along its bottom side to the top surface of the first decorative material or a tent card greeting card member having an upper card and lower card portion connected by a fold, with the bottom of the lower card portion being restrainably and equivalently affixed to the top surface of the first decorative material means. With regard to ornamentation, decorative trim means are utilized, including ornamentative bows, sprigs, rings and associated decorations. Additionally, the preferred embodiment of the invention utilizes first decorative skirt material means and first decorative material means fabricated of a lacelike textile material, which, though more prone for slipage between the inner and outer hoop means, are nonetheless anchored in place therewithin through the utilization of the previously mentioned joinder region and anchoring arrangement.

DETAILED DESCRIPTION OF THE DRAWINGS

Figure 1:
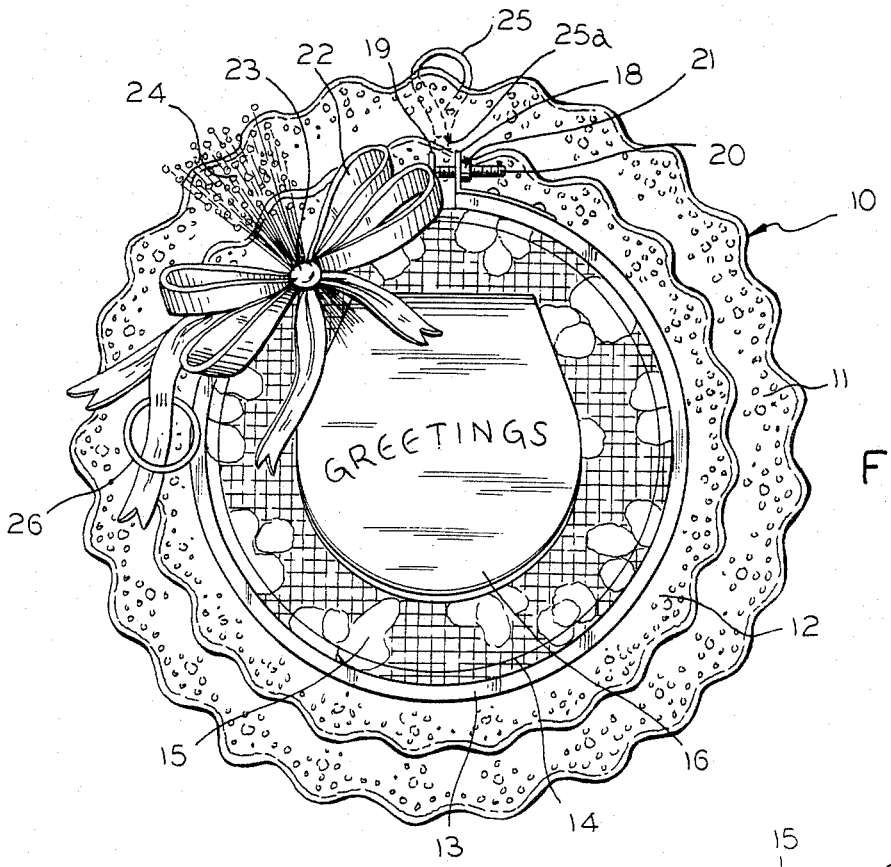
FIG. 1 of the drawings is a top plan view of the subject greeting gift apparatus showing, particularly, construction of the first decorative material means, and various decorative skirt material means within the arranged hoop members and with greeting card means positioned thereupon.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Figure 3:
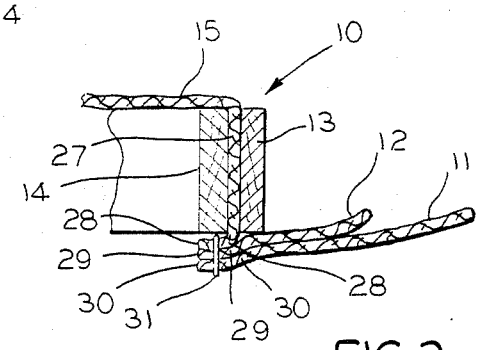
FIG. 3 is a partial enlarged cross-sectional view of the apparatus of FIG. 2, showing the anchoring construction and joinder region created by the various decorative and decorative skirt material means for cooperation with the inner and outer hoop means.
Figure 2:
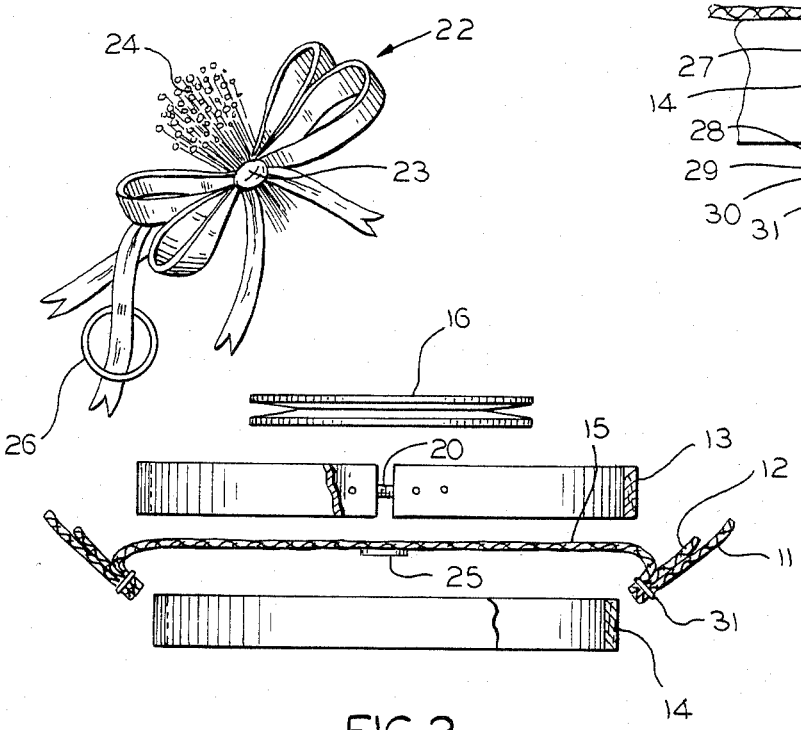
FIG. 2 is a front elevational view, in exploded portrayal, showing the positions of the decorative trim means, material and material skirt means, greeting card means and hoop means utilized in construction of the present invention.

Greeting gift apparatus 10 is shown in FIG. 1 as comprising first decorative material means 15 fabricated of a lace material stretched taut over inner hoop means 14, closely juxtaposed to outer hoop means 13 with material 15 interposed therebetween. First decorative skirt material means 12 is additionally shown emanating outwardly from beneath the inner and outer hoop means (as shown in FIGS. 2 and 3), and emanates directly from the "joinder region" which serves as an anchor member to effectively lock the position of first decorative material means 15. Second decorative skirt material means 11 is also shown comprising a border about first decorative skirt material means 15 in the same manner as first decorative skirt material means 12 provides a decorative border about outer hoop means 13. In the preferred embodiment of the invention, first and second decorative skirt material means 12 and 11, respectively, are equivalently formed of a lace-like material either matching or contrasting the lace-like material utilized in first decorative material means 15. Also shown in FIG. 1 is greeting card member 16, here comprising a tent-type greeting card having a top and bottom portion connected by a fold, in which the bottom portion, and particularly the bottom surface of the bottom portion, is adhesively or otherwise fixedly restrained to the top surface of first decorative material means 15.

In the preferred embodiment shown in FIG. 1, an adjustable circular embroidery hoop construction is utilized in which both outer hoop means 13 and inner hoop means 14 are circular in construction and in which inner hoop means is fixed in size, while outer hoop means 13 is adjustable through conventional embroidery hoop adjustment means, such as that embodying adjustment bolt 20, adjustment nut 21 and connection flanges 18 and 19. Decorative trim bow 22 with bow button 23, floral sprigs 24 and decorative ring 26 are also shown in FIG. 1, as is hanging ring attachment member 25 emanating along the back surface of the apparatus from either first decorative material means 15 or the back surfaces of the first or second decorative material skirt means 12 and 11, respectively. Through such a construction, an individual may convey greeting through utilization of a greeting card capable of bearing preprinted and/or personalized indicia messages integrated into a specific novel and preservable gift apparatus.

In FIG. 2 of the drawings, an exploded view of the invention is shown with tent-type greeting card 16 shown in position above outer hoop means 13 and inner hoop means 14. As previously described, outer hoop means 13 includes outer hoop adjustment means such as adjustment bolt 20 (together with cooperating elements to permit expansion and contraction of outer hoop means 13). Additionally, first decorative fabric 15 as well as first and second decorative skirts 12 and 11 respectively, are shown in FIG. 2 being attached at joinder region 13, here through textile stitching means. Preferably, the attachment of the first decorative material to the two decorative skirt materials is accomplished through continuous bonding along the entire exterior periphery of the first decorative skirt material means 15 and the internal peripheries of the decorative skirt means 12 and 11. This creates a joinder region at position 31 which serves as an anchor beneath the juxtaposed positions of outer and inner hoop means 13 and 14, respectively, so as to preclude the inadvertent and undesired retraction of the first decorative material through the hoop juxtaposition region, especially where the first decorative material means itself may be of a substantially thin, shiny or perforated construction which is otherwise, more capable of slipping through the juxtaposed sandwiched hoop configuration. Also shown in FIG. 2 is hanging ring 25 and decorative trim apparatus ring 26, ribbon button 23 as well as floral sprigs 24 making up decorative trim means 22.

The manner in which continuous attachment-joinder region 31 serves to anchor the textile or other decorative and decorative skirt material means in place is shown in FIG. 3 in which first decorative material means 15 is shown emanating downwardly between juxtaposed inner hoop 14 and outer hoop 13 which, upon construction, have been tightened together. Immediately beneath the lower surfaces, respectively, of inner and outer hoop 14 and 13, the outer peripheral portion 28 of first decorative material means 15 is gathered and juxtaposed to the inner peripheral portions 29 and 30 of first decorative skirt material means 12 and second decorative skirt material means 11 respectively. Portions 28, 29 and 30 are then attached through either sewing, adhesive or thermoplastic joinder, at joinder region 31. The overall bulk of material portions 28, 29 and 30 together with joinder region attachment means 31 creates an overall element which is incapable of being drawn through the substantially tight region between inner hoop 14 and outer hoop 13, notwithstanding the thinness, sliding and/or porous nature of the material interposed therebetween, so as to effectively anchor the positions of not only the tautly stretched first decorative material means 15, but also the position of the first and second decorative skirt material means 12 and 11, respectively.

The foregoing description and drawings merely explain and illustrate the invention and the invention is not limited thereto, except insofar as the amended claims are so limited as those skilled in the art who have the disclosure before them will be able to make modifications and variations therein without departing from the scope of the invention. For example, it is contemplated to be within the scope of the present invention that entertainment means be further associated with one embodiment of apparatus through the addition of relatively small music box means within the interior surface of the inner hoop, along the backside of the first decorative material means. In this particular embodiment, the "hidden" music box positioned beneath the first decorative material means, would be capable of playing a musical tune that would coincide with the "greeting" card, such as the tune "happy birthday" for utilization with the greeting card that conveys birthday greetings.

What is claimed is:

1. A novelty greeting gift apparatus for conveyance of greeting indicia in a preservable gift environment, said gift apparatus comprising:

first decorative material means stretched into a substantially taut geometric configuration;

inner hoop means having an interior surface and exterior surface;

the bottom peripheral portion of said first decorative tautly stretched material means being closely juxtaposed and overlapping the exterior surface of said inner hoop means;

outer hoop means having an interior surface and exterior surface, the top peripheral portion of said first decorative tautly stretched material means being closely juxtaposed and underlapping the interior surface of said outer hoop means;

said inner and outer hoop means being concentrically and fixedly juxtaposable proximate to one another with said first decorative material means interposed therebetween so as to maintain said first decorative material means in said substantially taut stretched configuration, first decorative skirt material means operably attached to the extreme outer circumference of said first decorative material means at a joinder region;

said joinder region being positioned immediately beneath the lowermost edges of said proximately juxtaposed inner and outer hoop means at the location from which said first decorative material means interposed therebetween said inner and outer hoop means emanates downwardly therefrom, said joinder region serving as an anchor member to effectively lock the position of said first decorative material means in its taut stretched configuration within the respective exterior surface and interior surface of said inner and outer hoop means respectively;

said first decorative skirt material means emanating outwardly from said joinder region beneath said inner and outer hoop means to define a decorative outer skirt member framing said outer loop means;

greeting card means restrainably affixed to the upper surface of said first decorative material means and bearing greeting indicia thereon; and decorative trim means operably attached to the upper surfaces of one or more of said first decorative material means, inner hoop means, outer hoop means and first decorative skirt means for overall enhancement thereof.

2. The novelty greeting gift apparatus according to claim 1 in which the invention further comprises;

second decorative skirt material means operably attached to the extreme outer circumference of said first decorative material means and the inner peripheral portion of said first decorative skirt material means at said joinder region, said second decorative skirt material means being positioned substantially below said first decorative skirt material means and emanating outwardly from said joinder region to define a second decorative outer skirt member immediately and outwardly framing said first decorative skirt material means.

3. The novelty greeting gift apparatus according to claim 1 in which the invention further comprises;

hanging ring attachment means comprising a hanging ring member attached to one or more of said first decorative material means, first decorative skirt material means and said second decorative skirt material means;

said hanging ring member enabling restrained positioning and display of said apparatus, as desired, upon a substantially vertical surface.

4. The invention according to claim 1 in which said joinder region of said first decorative material means and said first decorative material skirt means comprises a substantially continuously attached region forming a substantially bulky element incapable of being drawn through the region between the juxtaposed inner and outer hoop means, so as to effectively anchor the positions of both said first decorative material and said first decorative material skirt means beneath the substantially juxtaposed bottom surfaces of said inner and outer hoop means.

5. The invention according to claim 4 in which said region of continuous attachment comprises a continuous sewn attachment bond between said first decorative material means and said first decorative skirt material means.

6. The invention according to claim 4 in which said region of continuous attachment comprises a continuous adhesive attachment bond between said first decorative material means and said first decorative skirt material means.

7. The invention according to claim 4 in which said region of continuous attachment comprises a continuous thermoplastically joined attachment bond between said first decorative material means and said first decorative skirt material means;

each of said first decorative material skirt means and said first decorative material means being fabricated of a substantially thermoplastic material capable of bonding through application of thermoplastic bonding catalyst means therebetween.

8. The invention according to claim 1 in which said inner and outer hoop means comprises a substantially fixed inner embroidery hoop and a substantially adjustable outer embroidery hoop, respectively.

9. The invention according to claim 1 in which said geometric configuration in which said first decorative material means is stretched, is substantially that of a circle, each of said inner and outer hoop means comprising a substantially circular hoop member.

10. The invention according to claim 1 in which said greeting card means comprises a substantially flat greeting card for attachment, along its bottom side, to the top of said first decorative material means.

11. The invention according to claim 1 in which said greeting card means comprises a tent card member having an upper card and lower card portion connected by a fold, the bottom of said lower card portion being restrainably affixed to the top surface of said first decorative material means.

12. The invention according to claim 1 in which said decorative trim means includes one or more of ornamentative bows, sprigs, rings and decorations.

13. The invention according to claim 2 in which said first decorative material means, said first decorative skirt material means and said second decorative skirt material means are fabricated of a substantially lace-like textile material.

* * * * *